US007236609B1

(12) United States Patent
Tsangaris et al.

(10) Patent No.: US 7,236,609 B1
(45) Date of Patent: Jun. 26, 2007

(54) ELECTRO-ACOUSTIC TRANSDUCER WITH RESISTANCE TO SHOCK-WAVES

(75) Inventors: Paris Tsangaris, Itasca, IL (US); Thomas E. Longwell, Phoenix, AZ (US); Thomas E. Miller, Arlington Heights, IL (US); Dennis Ray Kirchhoefer, Plainfield, IL (US); Daniel M. Warren, Geneva, IL (US)

(73) Assignee: Knowles Electronics, LLC., Itasca, IL (US)

( * ) Notice: Subject to any disclaimer, the term of this patent is extended or adjusted under 35 U.S.C. 154(b) by 897 days.

(21) Appl. No.: 10/089,861

(22) PCT Filed: Oct. 6, 2000

(86) PCT No.: PCT/US00/27522

§ 371 (c)(1),
(2), (4) Date: Aug. 8, 2002

(87) PCT Pub. No.: WO01/26413

PCT Pub. Date: Apr. 12, 2001

Related U.S. Application Data

(60) Provisional application No. 60/158,572, filed on Oct. 7, 1999, provisional application No. 60/180,547, filed on Feb. 7, 2000.

(51) Int. Cl.
*H04R 25/00* (2006.01)

(52) U.S. Cl. ..... 381/417; 381/418; 381/412

(58) Field of Classification Search ..... 381/396, 381/412, 413, 414, 417, 418, 176; 335/252, 335/302; 29/594, 609.1
See application file for complete search history.

(56) References Cited

U.S. PATENT DOCUMENTS

| | | | | |
|---|---|---|---|---|
| 1,871,739 | A | 8/1932 | Ringel | |
| 2,143,097 | A | 1/1939 | Warneke | |
| 2,994,016 | A | 7/1961 | Tibbetts et al. | |
| 3,111,563 | A | 11/1963 | Carlson | |
| 3,163,723 | A | 12/1964 | Tibbetts | |
| 3,172,022 | A | 3/1965 | Tibbetts | |
| 3,177,412 | A | 4/1965 | Carlson | |
| 3,182,384 | A | 5/1965 | Carlson et al. | |
| 3,347,991 | A | 10/1967 | Carlson | |
| 3,432,622 | A | 3/1969 | Sebesta et al. | |
| 3,531,745 | A * | 9/1970 | Tibbetts | 335/231 |
| 3,617,653 | A | 11/1971 | Tibbetts et al. | |
| 3,935,398 | A | 1/1976 | Carlson et al. | |
| 4,272,654 | A | 6/1981 | Carlson | |

(Continued)

FOREIGN PATENT DOCUMENTS

| | | |
|---|---|---|
| FR | 551 182 | 5/1922 |

(Continued)

*Primary Examiner*—Huyen Le
(74) *Attorney, Agent, or Firm*—Marshall Gerstein & Borun LLP

(57) ABSTRACT

A transducer comprising a pair of spaced magnets at least partially forming a tunnel having a central axis. A coil having a first and a second side wall and an upper and a lower wall at least partially forms the tunnel. A reed having a central portion extends through the tunnel. The reed has a stationary end, a deflection end, and a tip portion which lies at least partially between the magnets, wherein the reed is mounted for deflection towards or away from the respective magnets.

34 Claims, 7 Drawing Sheets

U.S. PATENT DOCUMENTS

| | | | |
|---|---|---|---|
| 4,410,769 | A | 10/1983 | Tibbetts |
| 4,518,831 | A | 5/1985 | Stanley et al. |
| 5,647,013 | A | 7/1997 | Salvage et al. |
| 6,041,131 | A | 3/2000 | Kirchhoefer et al. |

FOREIGN PATENT DOCUMENTS

| | | |
|---|---|---|
| FR | 564 941 | 4/1923 |

* cited by examiner

ELECTRO-ACOUSTIC TRANSDUCER WITH RESISTANCE TO SHOCK-WAVES

RELATED APPLICATIONS

This application claims priority to U.S. Provisional Patent Application entitled "Transducer With Resistance To Lateral Shock," Ser. No. 60/158,572, filed Oct. 7, 1999 and U.S. Provisional Patent Application entitled "Transducer With Resistance To Shock," Ser. No. 60/180,547, filed Feb. 7, 2000. Both applications and U.S. Pat. No. 5,647,013, entitled "Electrostatic Transducer," issued Jul. 8, 1997, are incorporated herein.

TECHNICAL FIELD

This invention relates to a transducer, suitable for use within hearing aids, for reducing shock.

BACKGROUND OF THE INVENTION

It is known that transducers include a coil with a first air gap or tunnel, magnetic members, such as spaced apart permanent magnets, having a second air gap or tunnel, and a reed armature. The first and second air gaps are generally aligned, with the armature reed extending through the first and second air gaps.

The arrangement is such that when the moving part of the reed shifts in one direction or another away from a centralized position between the two poles, the magnetic flux is caused to flow in one direction or the other along the reed and hence through the coil. The reed is attached to a diaphragm and in this way the vibrations of the diaphragm caused by received sound are converted into corresponding currents in the coil or vice versa. If the transducer experiences a shock e.g., from being dropped, the reed can be easily damaged due to over deflection or unwanted deflection in the horizontal and/or vertical directions. In addition, the tip portion of the reed may strike the magnet with considerable force on the upper or lower side walls of the tunnel formed within the coil. Reference can be made to U.S. Pat. No. 5,647,013 for one such arrangement.

To reduce and prevent unwanted deflection of the armature's reed, the tunnel of the transducer can be tapered (inwardly or outwardly) from the fixed or stationary end of the armature toward the deflection end of the reed. In addition, a contact point can extend into the tunnel to reduce or prevent unwanted horizontal deflection of the armature reed. These previous techniques still require the reed to contact the surface of the tunnel and this contact can cause damage to the reed.

This invention is designed to prevent these and other problems.

SUMMARY OF THE INVENTION

According to a first embodiment of the present invention, a transducer resistant to shock comprises a stack having a pair of spaced magnets at least partially forming a tunnel. The tunnel has a central axis and the magnets have an upper and a lower tunnel wall. A coil at least partially forms the tunnel. The coil has a first and a second side wall and an upper and lower wall. Extending through the tunnel is a reed having a central portion, a stationary end, and a deflection end, wherein the reed has a tip portion which lies at least partially between the magnets. The reed is mounted for deflection towards or away from the magnets. A shock protective means is responsive to a shock impulse to the transducer where upon the protective means engages the reed. Preferably, the shock protective means comprises a ring fixedly attached between the coil and the stack. At least one bumper is attached to the ring in close proximity to the reed wherein the at least one bumper is responsive to an impulse shock to the transducer and the bumper acts to contact the reed.

Another embodiment of the present invention is directed to a transducer comprising a pair of spaced magnets at least partially forming a tunnel. The tunnel has a central axis. A coil having a first and a second side wall and an upper and lower wall at least partially forms the tunnel. A reed having a stationary end, a deflection end, and a central portion, extends through the tunnel. A tip portion of the reed lies at least partially between the magnets. The reed is mounted for deflection towards or away from the respective magnets. The coil has a first end toward the stationary end of the reed and a second end toward the magnets, wherein at least one side wall of the coil is tapered (inwardly or outwardly) from the central axis from the first end of the coil to the second end of the coil.

Other advantages and aspects of the present invention will become apparent upon reading the following description of the drawings and detailed description of the invention.

DETAILED DESCRIPTION

Figure 1:
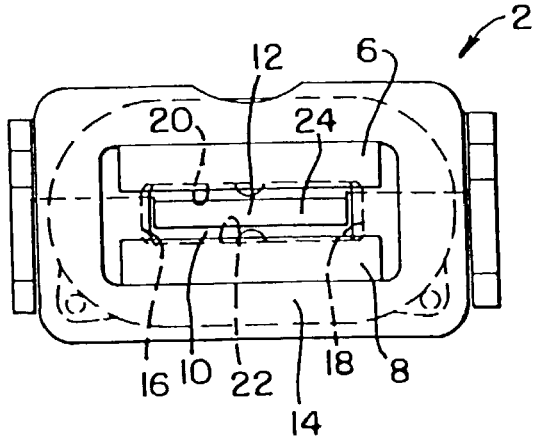
FIG. 1 is front view of the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2:
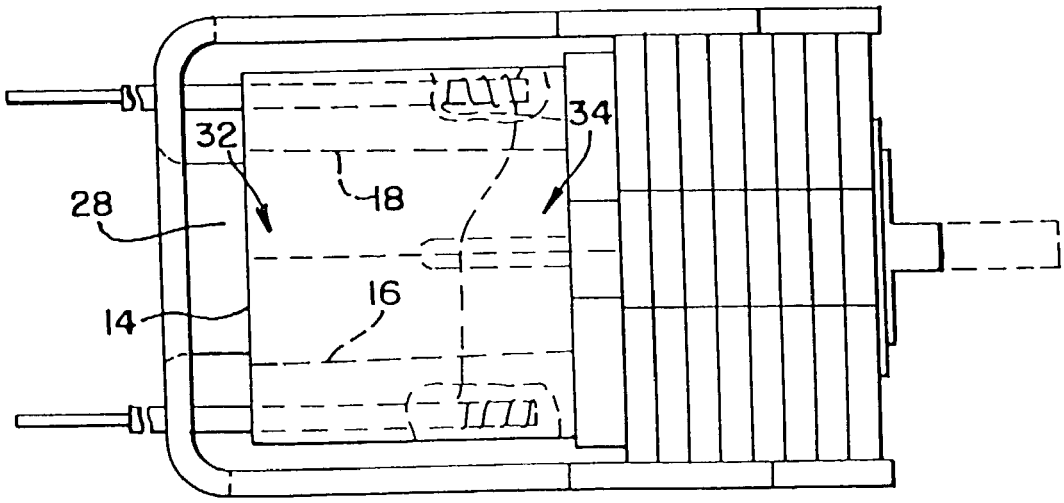
FIG. 2 is a rotated top view of the present invention shown in FIG. 1.
Figure 4:
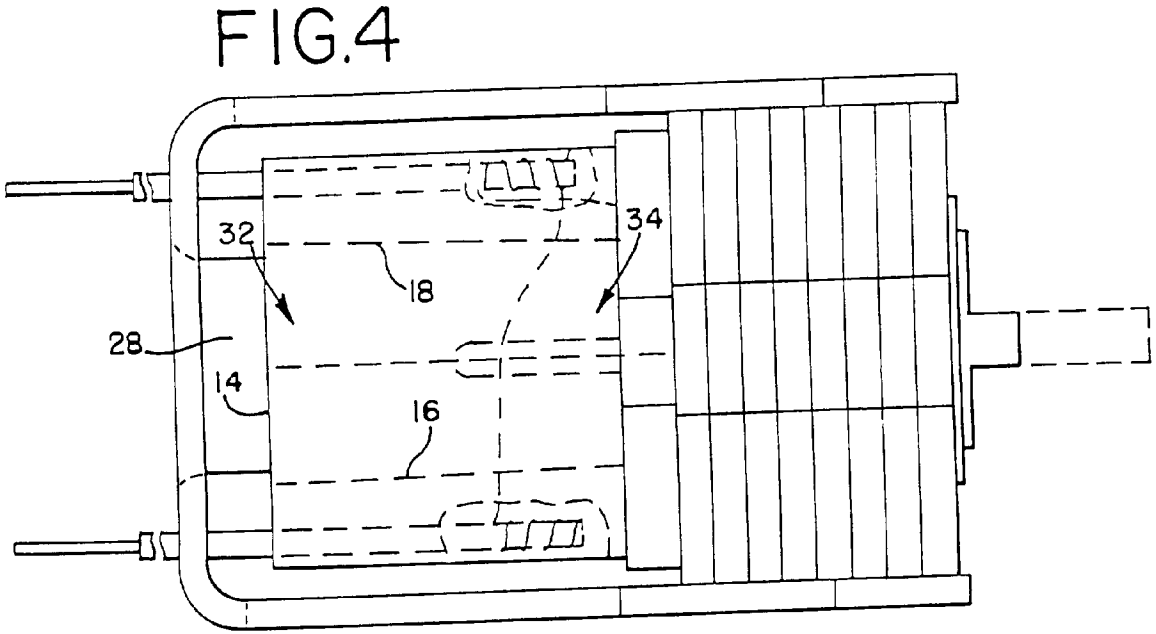
FIG. 4 is an enlarged view of FIG. 2.
Figure 3:
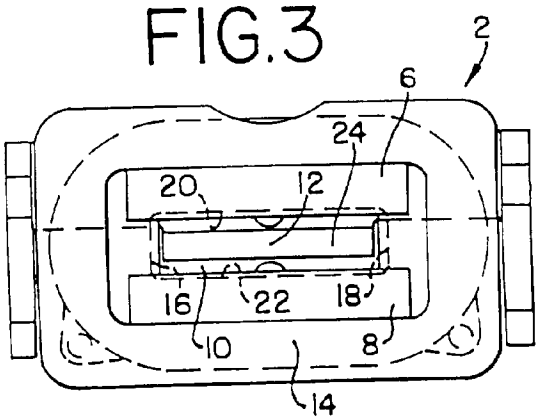
FIG. 3 is an enlarged view of FIG. 1.
Figure 5:
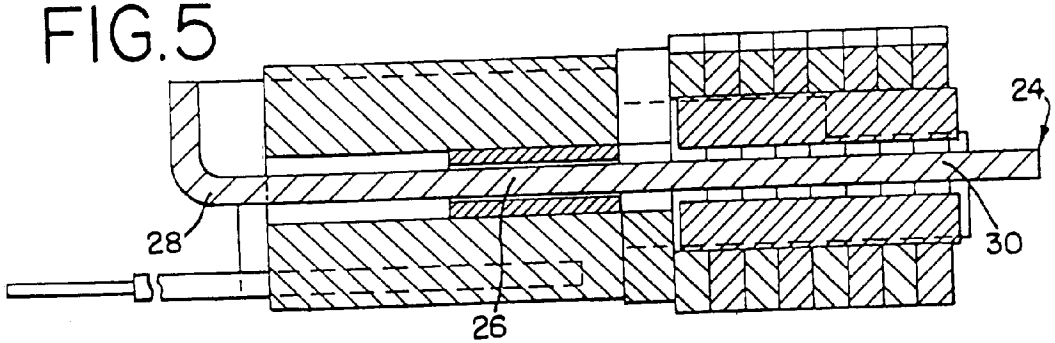
FIG. 5 is a cut-away side view of the present invention.

FIG. 1 is a front view of a transducer 2 with its housing 4 (see FIGS. 17 and 18) removed. FIG. 2 is a top/rotated view of the transducer of FIG. 1. FIG. 3 is an enlarged view of FIG. 1, and FIG. 4 is an enlarged view of FIG. 2. FIG. 5 is a cut-away side view of the transducer of FIG. 1.

The transducer 2 of these figures has a pair of spaced magnets 6, 8 at least partially forming a tunnel 10. The tunnel having a central axis 12. The transducer 2 further has a coil 14 at least partially forming the tunnel 10. The coil has a first and a second side wall 16, 18 and an upper and lower wall 20, 22. The transducer 2 further has a reed 24 having a central portion 26 which extends through the tunnel 10, a stationary end 28, and a deflection end 30. The reed 24 has a tip portion 30 which lies at least partially between the magnets 6,8. The reed 24 is mounted for deflection towards and/or away from the respective magnets 6, 8.

The coil 14 has a first end 32 toward the stationary end 28 of the reed 24 and a second end 34 toward the magnets 6,8. The side walls 16, 18 of the coil 14 are tapered inwardly toward the central axis 12 from the first end 32 of the coil 14 to the second end 34 of the coil 14, to prevent or reduce unwanted horizontal deflection of the reed 24. Alternatively, the side walls 16, 18 of the coil 14 can be tapered outwardly away from the central axis 12 from the first end 32 of the coil 14 to the second end 34 of the coil 14, to prevent or reduce unwanted horizontal deflection of the reed 24. Alternatively, at least a part or stretch of at least one side wall 16, 18 of the coil can be tapered outwardly away from the central axis 12, moving toward the second end 34 of the coil 14, to prevent or reduce unwanted horizontal deflection of the reed 24. Likewise, at least a part or stretch of at least one side wall 16, 18 of the coil can be tapered inwardly toward the central axis 12, moving toward the second end 34 of the coil 14, to prevent or reduce unwanted horizontal deflection of the reed 24. For the above alternatives or other alternatives, having a coil wall, or any part or stretch thereof, that is tapered, the coil wall can further have a separate raised portion toward the central axis 12, in relation to the adjacent portion of the wall thereof.

Some of the Figures depict dimensions which can be used for the present invention. Other dimensions can be used as well. For the embodiments in FIGS. 1 through 5, one set of dimensions are as follows: the nominal lateral reed clearance is (0.0625"/1.59 mm) (nominal tunnel width)−(0.0595"/1.51 mm)(nominal reed width)=(0.003"/0.076 mm) or (0.0015"/0.038 mm) per side. Coil tunnel taper is (0.0045"/0.11 mm) over (0.093"/2.4 mm) length, or about 2.8°. The nominal reed to rib (top or bottom of the coil) is (0.0111"/0.282 mm) (nominal rib gap)−(0.008"/0.2 mm)(nominal reed thickness) =(0.0031"/0.079 mm), or (0.0015"/039 mm) top/bottom.

Figure 6:
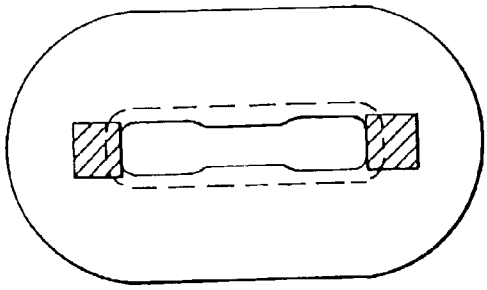
FIG. 6 is a front view of a coil winding bobbin for the present invention.
Figure 7:
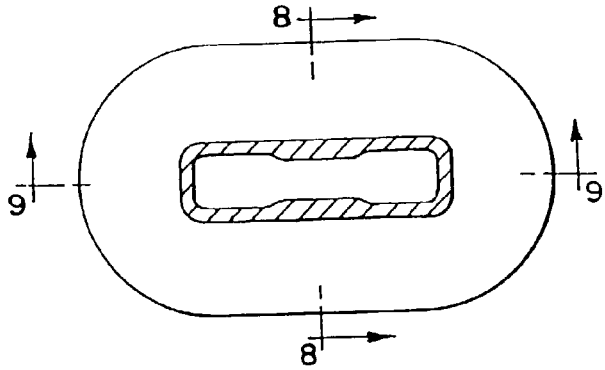
FIG. 7 is a rear view of the coil winding bobbin shown in FIG. 6.
Figure 9:
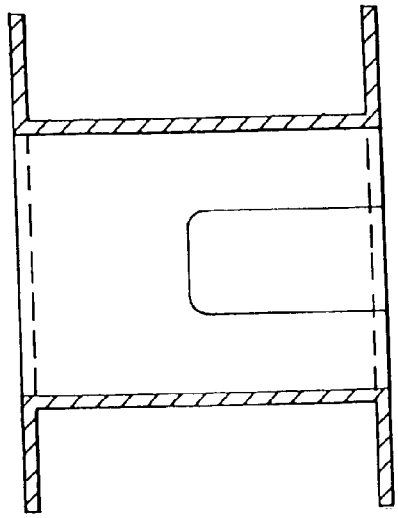
FIG. 9 is a cross section view of the coil winding bobbin shown in FIG. 7 along the line 9—9.
Figure 8:
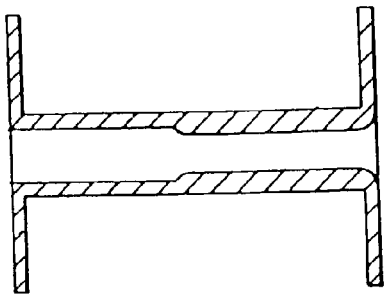
FIG. 8 is a cross section view of the coil winding bobbin shown in FIG. 7 along the line 8—8.

FIG. 6 is a front view of a further coil winding bobbin for a transducer 2 of the present invention. FIG. 7 is a back view of the coil winding bobbin of FIG. 6. FIG. 8 is a side view of the coil winding bobbin of FIG. 6. FIG. 9 is a top view of the coil winding bobbin of FIG. 6. These figures show one tapering that can be implemented within the coil winding for the present invention.

Figure 10:
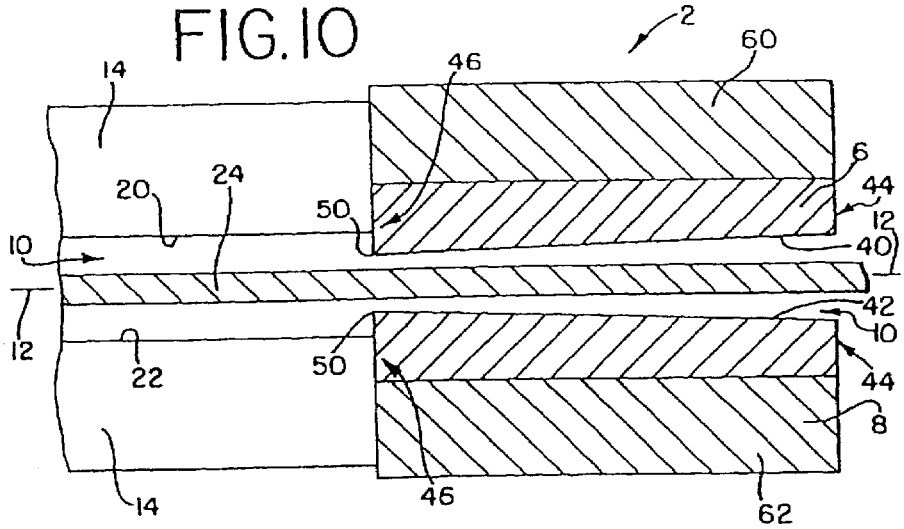
FIG. 10 is a side cut-away view of a portion of the present invention.

FIG. 10 is a side cut-away view of a portion of the transducer of the present invention. The transducer 2 therein has a pair of spaced magnets 6, 8. The magnets, 6,8 have upper and lower tunnel walls 40, 42. The magnets have a second end 44 toward the deflection end of the reed, and a first end 46 toward the coil 14. The upper and the lower tunnel walls 40, 42, or at least a part or stretch thereof, of the magnets 6,8, are tapered outwardly from the central axis 12, in a direction from the first end 46 of the magnets to the second end 44 of the magnets. This creates a possible contact point(s) 50 for the reed 24, depending on the angle of tapering. Preferably, with the proper angle of tapering, the reed 24 will not only contact at the contact point(s) 50, the reed 24 will contact along a significant or even the entire length of the magnets 6,8. In another embodiment, the tapering can take place in the opposite direction.

Figure 12:
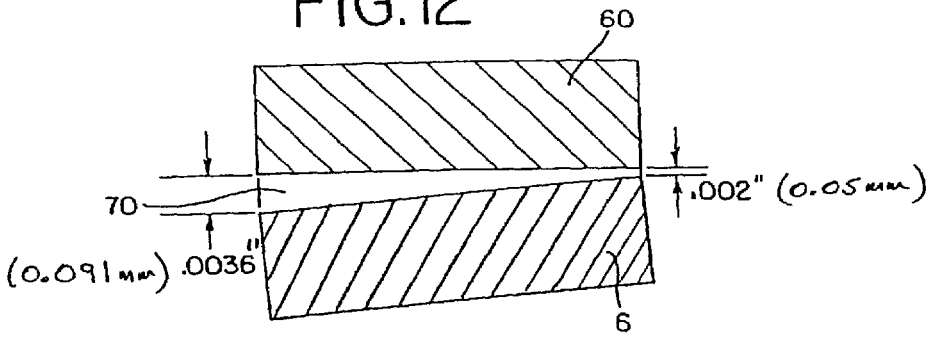
FIG. 12 is a partial side cut-away view of an alternative embodiment of the present invention.
Figure 11:
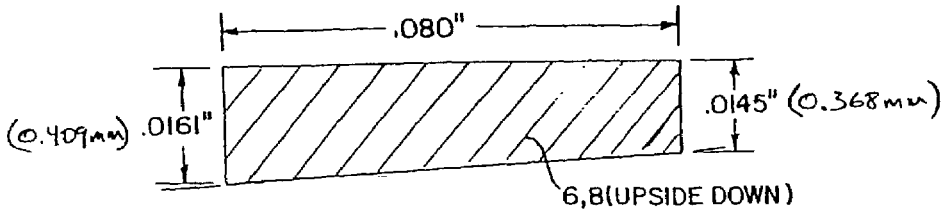
FIG. 11 is a view of one embodiment of a magnet of the present invention.

FIG. 10 further shows that the transducer 2 has a first and second (upper and lower) yoke portions 60, 62, which can comprise a stack, as is known in the art. FIG. 11 is a magnet 6,8 indicating one set of measurements for one or both of the magnets 6,8 in view of FIG. 10. FIG. 12 shows an alternative to the transducer of FIG. 10. This embodiment has a shim 70 between the first yoke portion 60 and the magnet 6. The shim 70 causes at least one of the upper and the lower tunnel walls 40, 42, or a part of a stretch thereof, of the magnets 6,8, to be tapered outwardly from the central axis 12, in a direction from the first end of the magnets to the second end of the magnets. The shim 70 could be placed in the opposite direction, between the magnet 6 and respective yoke portion 60, to reverse the tapering.

Figure 13:
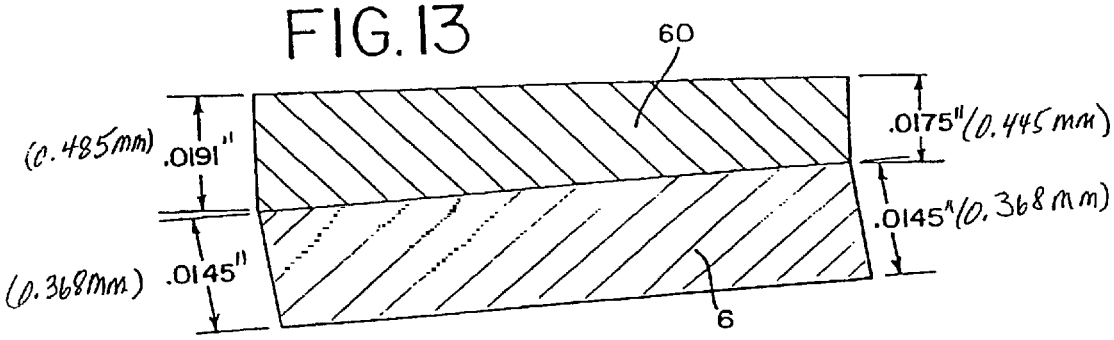
FIG. 13 is a partial side cut-away view of an alternative embodiment of the present invention.

FIG. 13 shows a further embodiment of the transducer of FIG. 10, the main difference being that the tapering is caused by the yoke portion being tapered instead of the magnets being tapered. It should be understood that both the yoke portion and the magnet could be tapered to achieve the same tapering effect.

Figure 14:
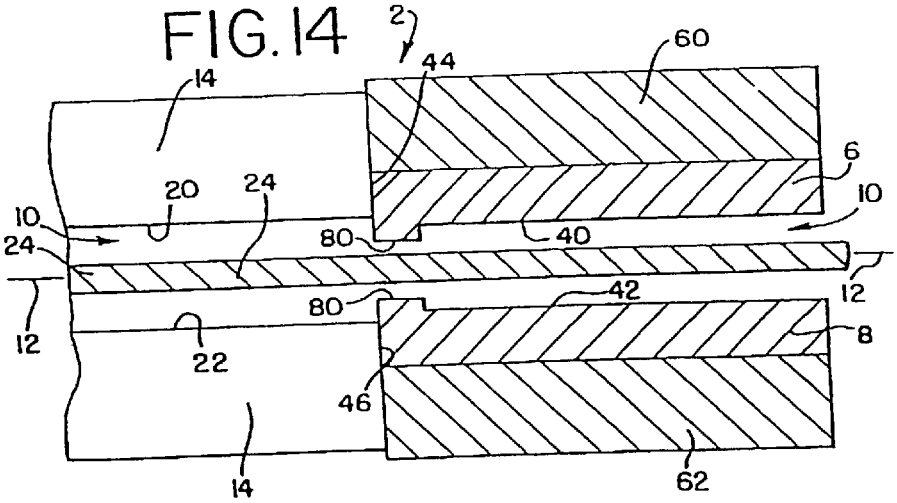
FIG. 14 is a partial side cut-away view of an alternative embodiment of the present invention.
Figure 15:
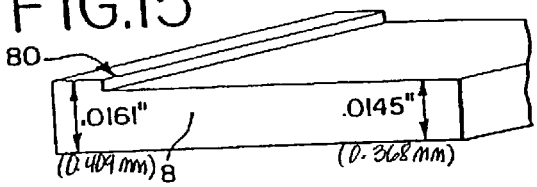
FIG. 15 is partial view of a magnet of an alternative embodiment of the present invention.
Figure 16:
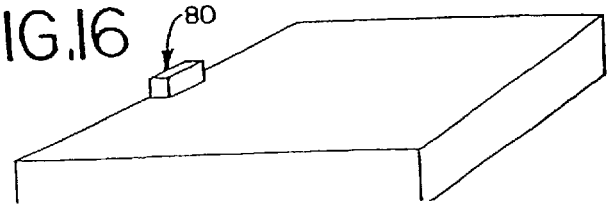
FIG. 16 is partial view of a magnet of an alternative embodiment of the present invention.

FIGS. 14, 15, and 16 show further embodiments of the transducer 2 of present invention. The upper and lower tunnel walls 40, 42 of the magnets 6,8 have a raised portion 80 inwardly toward the central axis 12 toward the first end 46 of the magnets 6,8. The raised portion 80 can extend substantially the width of the tunnel, as shown in FIG. 15, or less than the entire width, as shown in FIG. 16. It should be understood that the raised portion can be provided at or along other areas of the upper and/or lower tunnel walls 40, 42.

Figure 17:
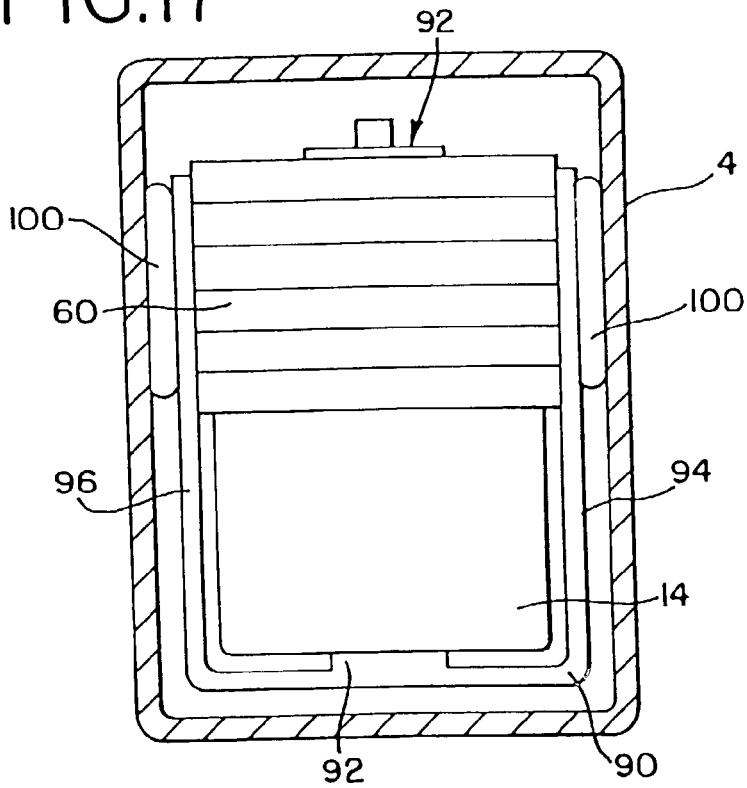
FIG. 17 is a front view of an alternative embodiment of the present invention.
Figure 18:
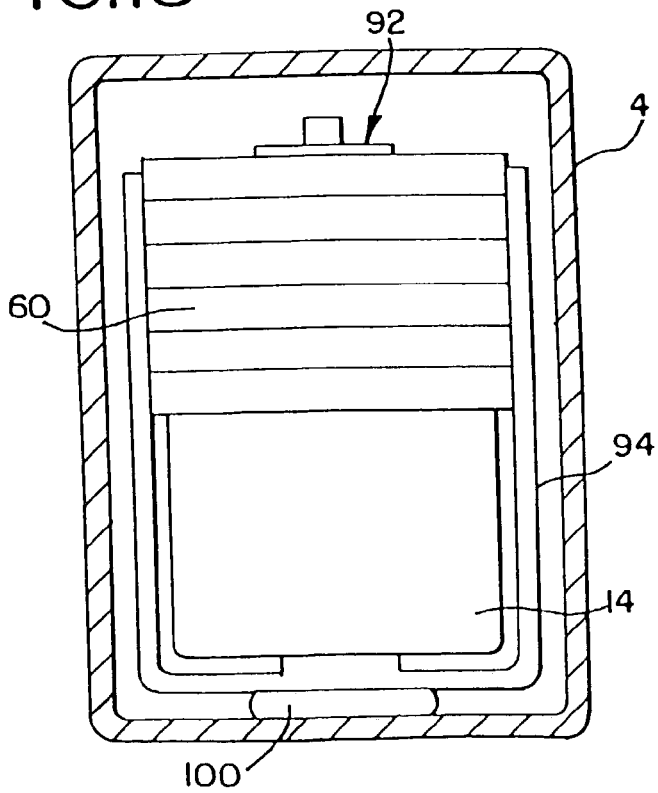
FIG. 18 is a front view of an alternative embodiment of the present invention.

FIGS. 17 and 18 show further embodiments of the transducer of the present invention. The transducer 2 has a housing 4. An armature 90 has a reed 92, and a first leg 94 and a second leg 96 extending along opposed sides of the exterior of a coil 14 and a yoke 60. Spacers 100, which can be comprised of a resilient epoxy or RTV, are position between the housing 4 and the first and second legs 94, 96 of the armature 90. FIG. 18 shows that another spacer 100 can be positioned between the housing 4 and the armature 90 adjacent the stationary end of the reed 92.

Figure 19:
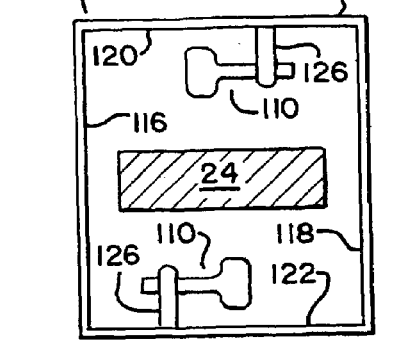
FIG. 19 is a front view of an alternative embodiment of the present invention.

Active shock protection means 104 of the armature's reed 24 can be incorporated as an alternative to the spacers 100. The shock protection means 104 is idle until a shock is absorbed by the transducer 2. FIG. 19 is a front view of an alternative embodiment of the present invention having shock protective means 104. The shock protective means 104 comprises a pair of bumpers 110 on opposing sides 120, 122 of a reed 24. The shock protective means 104 will reduce and prevent unwanted movement of the reed 24 caused by a shock impulse. Under normal conditions, the active bumpers 110 remain out of contact with the reed 24 as depicted in FIG. 19. As the transducer 2 receives a shock impulse, the active bumpers 110 will engage the reed 24 to prevent damage by clamping or inhibiting the reed 24 from movement.

Preferably, the shock protective means 104 includes a ring 106, preferably metal, circumferentially positioned about the central axis 12 of the tunnel 10. The ring 108 has opposing upper 120 and lower 122 walls; and opposing side walls 116, 118. Extending from the upper 120 and lower 122 walls of the ring 106 and toward the armature's reed 24 is a bumper 110. Each bumper 110 is attached to the upper 120 and lower 122 wall of the ring 106 by a flexible band 126, preferably made of flurosilicon. The flexible band 126 may be molded directly onto the ring 106 and the bumpers 110 by Flexan (TM). The bumpers 110 remain away from the reed 24 until the transducer 2 encounters a vertical shock impulse.

Figure 20:
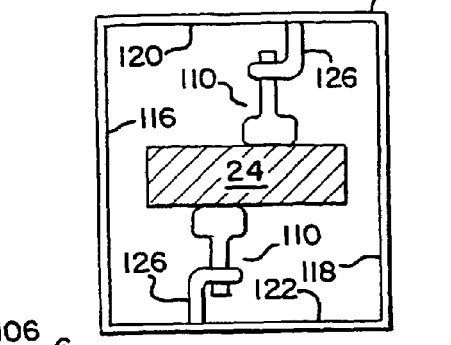
FIG. 20 is a front view of an alternative embodiment of the present invention.
Figure 23:
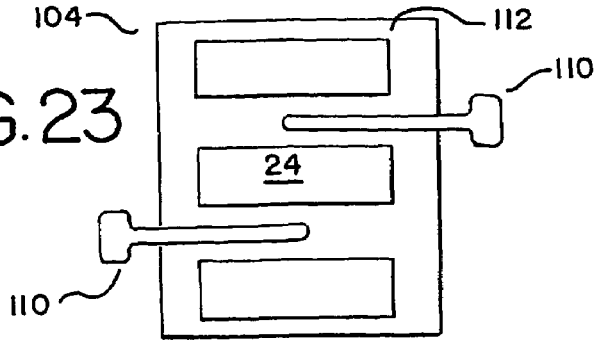

As the transducer 2 receives a vertical shock impulse, the protective bumpers 110 of the shock protective means 104 respond to the vertical shock impulse and move to engage the reed 24. FIG. 20. It is to be understood that although the present embodiment discloses the active shock protective means 104 as having a pair of bumpers 110 on opposing sides 120, 122 of the reed, the present invention includes alternative embodiments having at least one bumper 110 in close proximity to the reed 24 so as to engage the reed 24 in response to a shock impulse. Another alternative embodiment shown in FIG. 23 depicts shock protective means 104 having a molded flexible gasket 112.

Figure 21:
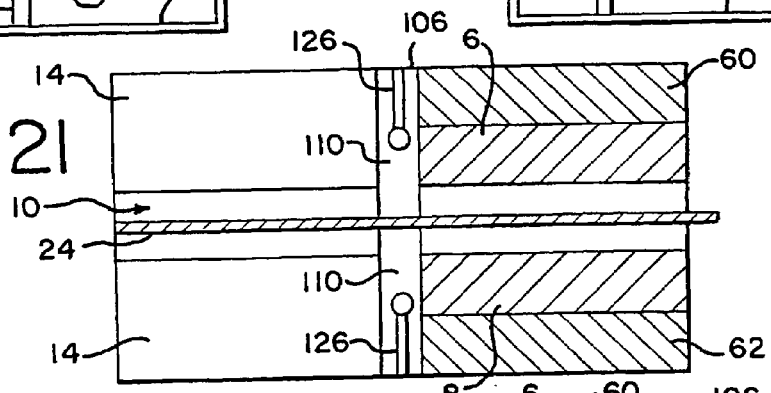
FIG. 21 is a side view of an alternative embodiment of the present invention.
Figure 22:
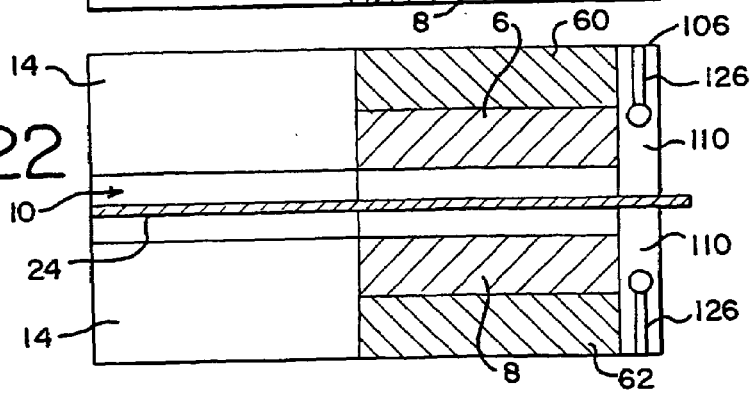
FIG. 22 is a side view of an alternative embodiment of the present invention; and, FIG. 23 is a front view of an alternative embodiment of the present invention.

The active shock protective means 104 can be positioned between the stack and the coil 14. FIG. 21. Alternatively, the active shock protective means 104 can be positioned at the end of stack near the deflection end 30 of the reed 24. FIG. 22.

While the specific embodiments have been illustrated and described, numerous modifications come to mind without significantly departing from the spirit of the invention and the scope of protection is only limited by the scope of the accompanying claims.

We claim:

1. A transducer comprising:

a pair of spaced magnets, the pair of spaced magnets forming a first passage;

a coil, the coiling being formed to include a second passage;

the first passage and the second passage respectively forming a first portion and a second portion of a tunnel, the tunnel having a central axis, a first side wall and a second side wall, the first side wall and the second side wall defining a nominal tunnel width, and a first upper wall and a second upper wall, the first upper wall and the second upper wall defining a nominal rib gap;

a reed having a central portion that extends through the tunnel, a stationary end and a deflection end, wherein the reed has a tip portion that lies at least partially within the first passage, the reed being mounted such that a portion of the reed is free to be deflected towards or away from respective ones of the pair of spaced magnets;

the coil having a first end disposed toward the stationary end and a second end disposed adjacent the magnets;

the pair of magnets having a first end disposed adjacent the second end of the coil and a second end disposed toward the deflection end of the reed;

the tunnel having a tapered portion, the tapered portion either increasing or decreasing the nominal rib gap at the tapered portion, wherein the tapered portion comprises each of the first portion or the second portion.

2. The transducer of claim 1, wherein the tapered portion provides the nominal rib gap that gradually decreases.

3. The transducer of claim 1, wherein the tapered portion provides the nominal rib gap that gradually increases.

4. The transducer of claim 1, wherein the tapered portion has a slope, the slope being substantially equal to a slope of the reed when it is deflected to a position at which it contacts the tapered portion.

5. The transducer of claim 1, wherein the tapered portion comprises a first shim and a second shim disposed respectively between a first magnet of the pair of magnets and a second magnet of the pair of magnets and a yoke structure.

6. The transducer of claim 1, wherein the tapered portion comprises a first reduced thickness portion of a first magnet of the pair of magnets and a second reduced thickness portion of a second magnet of the pair of magnets.

7. The transducer of claim 1, wherein the transducer comprises a yoke, the pair of magnets being secured to the yoke, and the tapered portion comprises a tapered portion of the yoke.

8. The transducer of claim 1, wherein the tapered portion is configured to limit displacement of the reed within the tunnel.

9. The transducer of claim 1, the tunnel comprising a second tapered portion, the second tapered portion either increasing or decreasing the nominal tunnel width at the second tapered portion, wherein the second tapered portion comprises one of the first portion or the second portion.

10. The transducer of claim 9, wherein the second tapered portion provides the nominal tunnel width that gradually decreases.

11. The transducer of claim 9, wherein the second tapered portion comprises a portion of each of the first portion and the second portion.

12. The transducer of claim 9, the second tapered portion provides the nominal tunnel width that gradually increases.

13. The transducer of claim 9, wherein the second tapered portion has a slope, the slope being substantially equal to a slope of the reed when it is deflected to a position at which it contacts the second tapered portion.

14. The transducer of claim 9, wherein the second tapered portion comprises a first shim and a second shim disposed respectively between a first magnet of the pair of magnets and a second magnet of the pair of magnets and a yoke structure.

15. The transducer of claim 9, wherein the second tapered portion comprises a first reduced thickness portion of a first magnet of the pair of magnets and a second reduced thickness portion of a second magnet of the pair of magnets.

16. The transducer of claim 9, wherein the transducer comprises a yoke, the pair of magnets being secured to the yoke, and the second tapered portion comprises a tapered portion of the yoke.

17. The transducer of claim 9, the coil comprising bobbin and wherein the second tapered portion comprises a core portion of the bobbin.

18. A transducer comprising:

a pair of spaced magnets, the pair of spaced magnets forming a first passage;

a coil, the coiling being formed to include a second passage;

the first passage and the second passage respectively forming a first portion and a second portion of a tunnel, the tunnel having a central axis, a first side wall and a second side wall, the first side wall and the second side wall defining a nominal tunnel width, and a first upper wall and a second upper wall, the first upper wall and the second upper wall defining a nominal rib gap;

a reed having a central portion that extends through the tunnel, a stationary end and a deflection end, wherein the reed has a tip portion that lies at least partially within the first passage, the reed being mounted such that a portion of the reed is free to be deflected towards or away from respective ones of the pair of spaced magnets;

the coil having a first end disposed toward the stationary end and a second end disposed adjacent the magnets;

the pair of magnets having a first end disposed adjacent the second end of the coil and a second end disposed toward the deflection end of the reed;

the tunnel having a tapered portion, the tapered portion either increasing or decreasing the nominal tunnel width at the tapered portion, wherein the tapered portion comprises one of the first portion or the second portion.

19. The transducer of claim 18, wherein the tapered portion provides the nominal tunnel width gradually decreases.

20. The transducer of claim 18 wherein the tapered portion comprises each of the first portion and the second portion.

21. The transducer of claim 18, the tapered portion provides the nominal tunnel width that gradually increases.

22. The transducer of claim 18, wherein the tapered portion has a slope, the slope being substantially equal to a slope of the reed when it is deflected to a position at which it contacts the tapered portion.

23. The transducer of claim 18, wherein the tapered portion comprises a first shim and a second shim disposed respectively between a first magnet of the pair of magnets and a second magnet of the pair of magnets and a yoke structure.

24. The transducer of claim 18, wherein the tapered portion comprises a first reduced thickness portion of a first magnet of the pair of magnets and a second reduced thickness portion of a second magnet of the pair of magnets.

25. The transducer of claim 18, wherein the transducer comprises a yoke, the pair of magnets being secured to the yoke, the tapered portion comprises a tapered portion of the yoke.

26. The transducer of claim 18, wherein the tapered portion is configured to limit displacement of the reed within the tunnel.

27. The transducer of claim 18, the tunnel comprising a second tapered portion, the second tapered portion either increasing or decreasing the nominal rib gap at the second tapered portion, wherein the second tapered portion comprises one of the first portion or the second portion.

28. The transducer of claim 27, wherein the second tapered portion provides the nominal rib gap that gradually decreases.

29. The transducer of claim 27, wherein the second tapered portion comprises a portion of each of the first portion and the second portion.

30. The transducer of claim 27, wherein the second tapered portion provides the nominal rib gap that gradually increases.

31. The transducer of claim 27, wherein the second tapered portion has a slope, the slope being substantially equal to a slope of the reed when it is deflected to a position at which it contacts the second tapered portion.

32. The transducer of claim 27, wherein the second tapered portion comprises a first shim and a second shim disposed respectively between a first magnet of the pair of magnets and a second magnet of the pair of magnets and a yoke structure.

33. The transducer of claim 27, wherein the second tapered portion comprises a first reduced thickness portion of a first magnet of the pair of magnets and a second reduced thickness portion of a second magnet of the pair of magnets.

34. The transducer of claim 27, the coil comprising bobbin and wherein the second tapered portion comprises a core portion of the bobbin.

* * * * *

UNITED STATES PATENT AND TRADEMARK OFFICE

CERTIFICATE OF CORRECTION

PATENT NO. : 7,236,609 B1
APPLICATION NO. : 10/089861
DATED : June 26, 2007
INVENTOR(S) : Paris Tsangaris et al.

It is certified that error appears in the above-identified patent and that said Letters Patent is hereby corrected as shown below:

On the Title Page:

At field (75), "Thomas E." should be -- Thomas F. --.

At field (73), "LLC." should be -- LLC --.

In the Related U.S. Application Data, add -- U.S. Pat. No. 5,647,013, filed July 8, 1997 --.

At field (74), "Marshall" should be -- Marshall, --.

In the Claims:

Add claim -- The transducer of claim 39 (1), wherein the tapered portion comprises each of the first portion and the second portion. --.

Signed and Sealed this

Twenty-ninth Day of April, 2008

JON W. DUDAS
*Director of the United States Patent and Trademark Office*

UNITED STATES PATENT AND TRADEMARK OFFICE

CERTIFICATE OF CORRECTION

PATENT NO. : 7,236,609 B1
APPLICATION NO. : 10/089861
DATED : June 26, 2007
INVENTOR(S) : Paris Tsangaris et al.

It is certified that error appears in the above-identified patent and that said Letters Patent is hereby corrected as shown below:

In the Claims:

"The transducer of claim 39 (1), wherein the tapered portion comprises each of the first portion and the second portion." (as added to set of claims in the Certificate of Correction issued April 29, 2008) is to be deleted.

Signed and Sealed this

Nineteenth Day of May, 2009

JOHN DOLL
*Acting Director of the United States Patent and Trademark Office*